US010300728B2

(12) United States Patent
Yamamoto et al.

(10) Patent No.: US 10,300,728 B2
(45) Date of Patent: May 28, 2019

(54) HEAT ROLLER AND PRINTING APPARATUS INCLUDING THE SAME

(71) Applicant: SCREEN HOLDINGS CO., LTD., Kyoto (JP)

(72) Inventors: Takaharu Yamamoto, Kyoto (JP); Junichi Shimizu, Kyoto (JP); Shinsuke Yamashita, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/899,786

(22) Filed: Feb. 20, 2018

(65) Prior Publication Data

US 2018/0281498 A1 Oct. 4, 2018

(30) Foreign Application Priority Data

Mar. 29, 2017 (JP) ..... 2017-065203

(51) Int. Cl.
*B41M 7/00* (2006.01)
*B41J 11/00* (2006.01)
*B41J 2/01* (2006.01)

(52) U.S. Cl.
CPC ..... *B41M 7/009* (2013.01); *B41J 2/01* (2013.01); *B41J 11/002* (2013.01)

(58) Field of Classification Search
CPC ..... B41M 7/009; B41J 2/01; B41J 11/002
See application file for complete search history.

(56) References Cited

U.S. PATENT DOCUMENTS

2002/0031360 A1* 3/2002 Umezawa ..... G03G 15/2003 399/67
2005/0025534 A1* 2/2005 Fujita ..... G03G 15/1665 399/307
2010/0225695 A1* 9/2010 Fujikura ..... B41J 11/002 347/16
2016/0052305 A1 2/2016 Yamamoto et al.

FOREIGN PATENT DOCUMENTS

JP 06-027630 A 2/1994
JP 2007-163989 A 6/2007
JP 2009-103873 A 5/2009
JP 2016-43482 A 4/2016

OTHER PUBLICATIONS

IP.com search (Year: 2018).*
Extended European Search Report issued in corresponding European Patent Application No. 18156460.0-1019, dated Jul. 23, 2018.

* cited by examiner

*Primary Examiner* — Lisa Solomon
(74) *Attorney, Agent, or Firm* — McDermott Will & Emery LLP

(57) ABSTRACT

A heat roller 18 includes a roller body 25 and a halogen lamp 26, the roller body 25 is a hollow cylinder constituted of aluminum or an aluminum alloy, and a thermal conversion efficiency of light from the halogen lamp 26 is not less than 70%. A printing apparatus includes the heat roller 18 disposed at a downstream side in a conveyance direction of a conveyance path for a printing medium than a printing unit.

2 Claims, 3 Drawing Sheets

HEAT ROLLER AND PRINTING APPARATUS INCLUDING THE SAME

CROSS REFERENCE

The present application claims priority from Japanese Patent Application No. 2017-65203, filed on Mar. 29, 2017, the entire contents of which are hereby incorporated by reference.

BACKGROUND OF THE INVENTION

1. Field of the Invention

The present invention relates to a heat roller, which, for example, is disposed in a conveyance path of a printing apparatus and is used for heating of a printing medium, etc., and a printing apparatus that includes the heat roller.

2. Description of the Related Art

With a printing apparatus, which performs printing by an inkjet printing method while conveying a long size printing medium (web), such as paper, film, etc., at a high speed, for example, of not less than 100 m per minute, there is a case where a size of an ink droplet is set larger than ordinary to suppress an influence of buoyancy that acts on the ink droplet due to conveyance of the printing medium. Generally in this case, to rapidly dry the ink printed on the printing medium being conveyed at the high speed, the ink is dried by heating the printing medium after printing.

There is known a printing apparatus that performs printing by the inkjet printing method on a long size printing medium that is conveyed along a conveyance path (see, for example, JP 2016-43482A). With the printing apparatus, for example, a heat roller is disposed in the conveyance path of the long size printing medium and the heat roller is heated and rotated. With the printing medium, conveyed along the conveyance path, a surface (back surface) at a side opposite a surface on which printing has been performed, is put in contact with an outer peripheral surface of the heat roller. The printing medium is thereby heated and the ink printed on the printing medium is dried.

As ink heating methods, various heating methods besides heating using a heat roller are known, for example, infrared irradiation, hot air heating, microwave heating, etc.

However, with infrared irradiation, drying proceeds from a surface of the ink droplet such that a film forms on the surface and drying of ink in an interior of the ink droplet may be impeded. Also, with hot air heating, a peripheral atmosphere of the printing medium must be heated over a wide range to heat a surface of the printing medium to a predetermined temperature, and therefore heating efficiency is low and high consumption power is required to dry the ink. Further, with microwave heating, the interior of the ink droplet is heated locally such that bumping of the ink, rupture of the ink droplet, etc., may occur.

On the other hand, the arrangement that heats the printed ink while putting the outer peripheral surface of the heat roller indirect contact with the printing medium enables the ink to be dried smoothly without giving rise to the above problems.

That is, high consumption power such as required in hot air heating is not required because heating is performed by putting the outer peripheral surface of the heat roller in direct contact with the printing medium. Also, an entirety of the ink printed on the printing medium can be dried substantially uniformly by heating from the back surface side of the printing medium. Impediment of drying of ink due to the film on the surface of the ink droplet as in the case of heating by irradiating infrared rays and localized heating of the interior of the ink droplet as in the case of microwave heating can thus be suppressed.

As the heat roller, for example, that which includes a cylindrical roller body and a heater disposed inside the roller body is used. For the roller body, aluminum or an aluminum alloy which is lightweight and enables reduction of power for rotational driving and has a suitable thermal conductivity, strength, etc., is used. Also, as the heater, for example, a halogen lamp is used.

It is known to uniformly roughen an inner peripheral surface of the roller body, constituted of aluminum or an aluminum alloy, by sandblast processing and thereafter perform anodization to form an anodic oxide film on the inner peripheral surface and to thereby shorten a heating rise time of the heat roller (see, for example, JP 2007-163989A).

With a halogen lamp, it is said that not less than 90% of consumption power is converted not to heat but to light. Therefore, with a heat roller that includes a halogen lamp, it is important to be able to convert the light from the halogen lamp to heat by making it be absorbed by the roller body as efficiently as possible. Thereby, the heating rise time of the heat roller can be shortened and the consumption power required to heat the heat roller to a predetermined temperature can be reduced.

Also, the energy of the light that is not converted to heat heats the air inside the roller body and the halogen lamp and the roller body may become damaged due to the air that has been made high in temperature by the heating. Therefore, by increasing an absorption efficiency of the light from the halogen lamp, temperature rise of the air inside the roller body can be suppressed to suppress the damaging of the halogen lamp and the roller body as well.

However, according to studies by the inventor, a roller body, such as that described in JP 2007-163989A, etc., and provided with an ordinary anodic oxide film with a thickness of not more than approximately 20 μm or a black anodic oxide film (black alumite film) with which the anodic oxide film is colored black by nickel plating, etc., is still low in the efficiency of absorbing and converting the light from the halogen lamp to heat. Therefore, the effect of shortening the heating rise time of the heat roller cannot be obtained sufficiently and the effect of reducing the consumption power for maintaining the heat roller at the predetermined heating temperature is also insufficient. Also, the effect of suppressing the temperature rise of the air inside the roller body to suppress the damaging of the halogen lamp and the roller body also cannot be said to be sufficient in some cases.

An object of the present invention is to provide a heat roller which is capable of drying ink efficiently at low consumption power, for example, when incorporated in a printing apparatus of an inkjet printing, and is capable of satisfactorily suppressing damaging of a halogen lamp and a roller body due to air inside the roller body being heated to a high temperature, due to being short in heating rise time, and low in consumption power required for heating to a predetermined temperature, and a printing apparatus which includes the heat roller.

SUMMARY OF THE INVENTION

One embodiment of the present invention is to provide a heat roller which includes a hollow cylindrical roller body, and a halogen lamp disposed inside the roller body. The roller body is constituted of aluminum or an aluminum alloy, and a thermal conversion efficiency of light from the halogen lamp is not less than 70%.

According to this configuration, the light from the halogen lamp can be converted to heat efficiently at an inner peripheral surface of the roller body, constituted of aluminum or an aluminum alloy. For example, according to studies by the inventor, the thermal conversion efficiency of light from a halogen lamp of a conventional roller body, such as that with which an ordinary black alumite film is formed on an inner peripheral surface, etc., is, in all cases, less than 70%. On the other hand, by selecting and using the roller body with the thermal conversion efficiency of light from the halogen lamp being not less than 70%, the light from the halogen lamp can be absorbed and converted to heat efficiently by the roller body to enable shortening of a heating rise time and lowering of consumption power required for heating to a predetermined temperature. Also, damaging of the halogen lamp and the roller body due to air inside the roller body being heated to a high temperature can be suppressed.

In one embodiment of the present invention, the roller body is constituted of aluminum or an aluminum alloy and has (1) needle-like structures with an aspect ratio of not less than 2 and not more than 30, (2) an anodic oxide film with a thickness of not less than 30 μm and not more than 100 μm, or (3) a composite coating film of fluororesin and ceramic formed on the inner peripheral surface to make the thermal conversion efficiency not less than 70%.

According to this configuration, by just forming any of (1) to (3) on the inner peripheral surface of the roller body that is constituted of aluminum or an aluminum alloy, the thermal conversion efficiency of the roller body can be made not less than 70% without making the roller body complex in structure or be greatly increased in weight.

That is, the needle-like structures of (1) are constituted of numerous recesses and projections between the respective recesses that are formed on the inner peripheral surface of the roller body, for example, by chemically etching the inner peripheral surface of the roller body. And, by adjusting the conditions of chemical etching, etc., the aspect ratio, expressed by the ratio (depth)/(opening width) of depth and opening width of the recesses, is set to be in the range of not less than 2 and not more than 30. A proportion at which the light from the halogen lamp taken inside the recesses is radiated outside the recesses without being converted to heat is thereby made low to enable the thermal conversion efficiency of the roller body as a whole to be made not less than 70%.

Also, the anodic oxide film of (2) may be formed by anodization of the inner peripheral surface of the roller body and, in its growth stage, numerous pores, extending in a thickness direction from a surface of the film and having an opening diameter of approximately 100 Å, form in the surface. And, by adjusting the conditions of anodization, etc., to make the thickness of the film not less than 30 μm and not more than 100 μm, a proportion at which the light from the halogen lamp taken inside the pores is radiated outside the pores without being converted to heat is made low to enable the thermal conversion efficiency of the roller body as a whole to be made not less than 70%.

Further, the composite coating film of fluororesin and ceramic of (3) has a porous structure, constituted of fine particles of the ceramic, in its interior and a proportion at which the light from the halogen lamp taken inside the porous structure is radiated outside the film without being converted to heat is made low to enable the thermal conversion efficiency of the roller body as a whole to be made not less than 70%.

Moreover, as mentioned above, the needle-like structures of (1) can be formed just by chemically etching the inner peripheral surface of the roller body that is constituted of aluminum or an aluminum alloy. Also, the anodic oxide film of (2) can be formed just by anodization of the inner peripheral surface. Further, the composite coating film of (3) can be formed, for example, by just coating a coating agent, containing a precursor of the ceramic and microparticles of the fluororesin, onto the inner peripheral surface and thereafter baking. Therefore, in all these cases, the thermal conversion efficiency of the roller body can be made not less than 70% without making the roller body complex in structure or be greatly increased in weight.

In one embodiment of the present invention is to provides a printing apparatus that includes a conveyance path for a printing medium, a printing unit performing printing by an inkjet printing method on the printing medium conveyed along the conveyance path, and a heat roller having features such as described above and being disposed at a downstream side in a printing medium conveyance direction of the conveyance path than the printing unit.

According to this configuration, by including the heat roller described above, for example, ink that is printed on the printing medium, which is conveyed at high speed, can be dried at high speed and efficiently with as low a consumption power as possible.

DETAILED DESCRIPTION OF THE PREFERRED EMBODIMENTS

Figure 1:
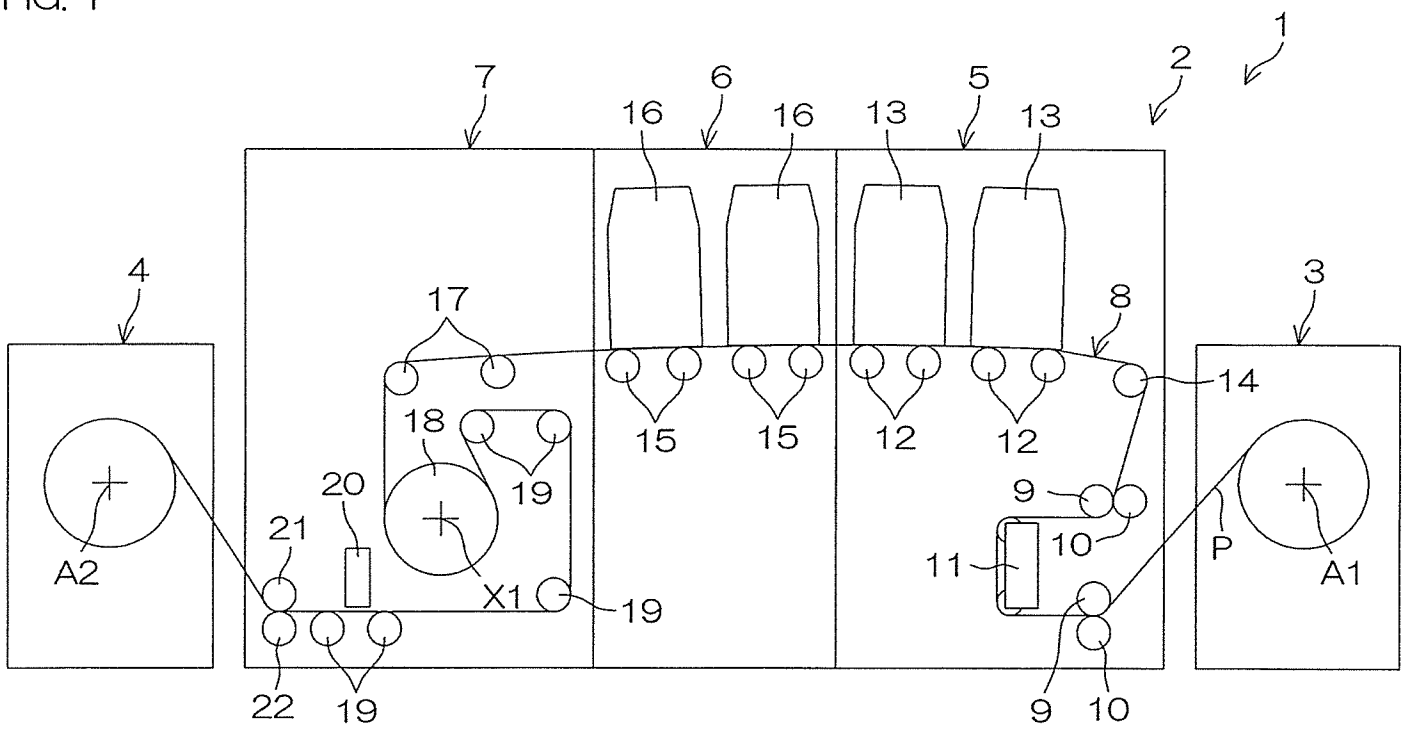
FIG. 1 is a side view of the general arrangement of a printing system that includes an inkjet printing apparatus as a printing apparatus according to a preferred embodiment of the present invention.

FIG. 1 is a side view of the general arrangement of a printing system 1 that includes an inkjet printing apparatus 2, as a printing apparatus according to a preferred embodiment of the present invention.

The printing system 1 includes the inkjet printing apparatus 2, a paper feed section 3 to supply a long size printing medium (web) P to the inkjet printing apparatus 2, and a paper recovery section 4 to wind the printing medium P on which printing has been performed by the inkjet printing apparatus 2 in a roll shape.

The paper feed section 3 holds a roll, into which the long size printing medium P has been wound, in a manner enabling rotation around a horizontal axis A1. The printing medium P drawn out from the paper feed section 3 is supplied to the inkjet printing apparatus 2.

The paper recovery section 4 winds up the printing medium P, on which printing has been performed by the inkjet printing apparatus 2, in a roll shape around a horizontal axis A2. To describe with a printing medium P feeding side as upstream and a printing medium P recovery side as downstream, the paper feed section 3 is disposed at an upstream side of the inkjet printing apparatus 2 and the paper recovery section 4 is disposed at a downstream side of the inkjet printing apparatus 2.

The inkjet printing apparatus 2 is constituted of a plurality of units aligned in a conveying direction. The inkjet printing apparatus 2 includes an entrance unit 5, an intermediate unit 6, and an exit unit 7 in that order from the paper feed section 3 side.

The entrance unit 5 includes a conveyance path 8, a drive roller 9, a nip roller 10, an edge adjusting unit 11, four conveying rollers 12, and two printing units 13. The drive roller 9, the nip roller 10, the edge adjusting unit 11, the conveying rollers 12, and the printing units 13 are disposed in that order from the paper feed section 3 side.

The drive roller 9 and the nip roller 10 take in the printing medium P from the paper feed section 3 and feed the printing medium P, which has been taken in, to the printing unit 13 side. The edge adjusting unit 11 automatically corrects the position of the printing medium P when it meanders in a width direction and thereby achieves appropriate conveyance of the printing medium P.

The four conveying rollers 12 installed in the entrance unit 5 are disposed along the conveyance path 8 and contact a lower surface of the printing medium P flowing through the conveyance path 8 to convey the printing medium P along the conveyance path 8.

Each printing unit 13 is, for example, an inkjet head that discharges ink droplets toward a front surface of the printing medium P to form a printed image. The two printing units 13 print ink of, for example, black (K) and cyan (C) colors in that order from the paper feed section 3 side.

In the entrance unit 5, a driven roller 14 is disposed between the conveying roller 12 at the most upstream side among the four conveying rollers 12 and the driving roller 9 and the nip roller 10 at the downstream side of the edge adjusting unit 11. The driven roller 14 is disposed at an inflection point of the conveyance path 8. The driven roller 14 is also called an encoder roller and an unillustrated encoder arranged to detect a rotation angle of the driven roller 14 is coupled to a rotating shaft thereof.

When the printing medium P is conveyed, the driven roller 14 rotates, an encoder shaft body of the encoder rotates in accompaniment with the rotation of the driven roller 14, and accordingly, the encoder outputs a signal corresponding to a conveyance speed. The signal is input into a controller (unillustrated). Based on the signal from the encoder, the controller performs control of the conveyance speed.

The intermediate unit 6 includes four conveying rollers 15 and two printing units 16.

The four conveying rollers 15 installed in the intermediate unit 6 are disposed along the conveyance path 8 and contact the lower surface of the printing medium P flowing through the conveyance path 8 to convey the printing medium P along the conveyance path 8.

Each printing unit 16 is, for example, an inkjet head that discharges ink droplets toward the printing medium P to form a printed image. The two printing units 16 print ink of, for example, magenta (M) and yellow (Y) colors in that order from the paper feed section 3 side.

The exit unit 7 includes a conveying roller 17, a heat roller 18, a conveying roller 19, an inspection section 20, a drive roller 21, and a nip roller 22 in that order from the upstream side of the conveyance path 8. The heat roller 18 incorporates a halogen lamp. The heat roller 18 is a unit arranged to heat the printing medium P to dry the ink printed on the front surface of the printing medium P. The heat roller 18 is driven to rotate in accordance with the conveying of the printing medium P. The inspection section 20 performs inspection concerning printing defects, such as stains, omissions, etc., in the printing (printed image) formed on the printing medium P. The inspected printing medium P is discharged from the exit unit 7 and wound in a roll shape at the paper recovery section 4. The inkjet printing apparatus 2 is provided to be capable of realizing a high printing resolution (for example, of approximately 1200 dpi).

Although a case where four units (corresponding to four colors) are provided as printing units 13 and 16 is cited as an example, in addition to these, a printing unit that discharges ink of gold color and a printing unit that discharges an overcoat material may be provided as suited.

Figure 2:
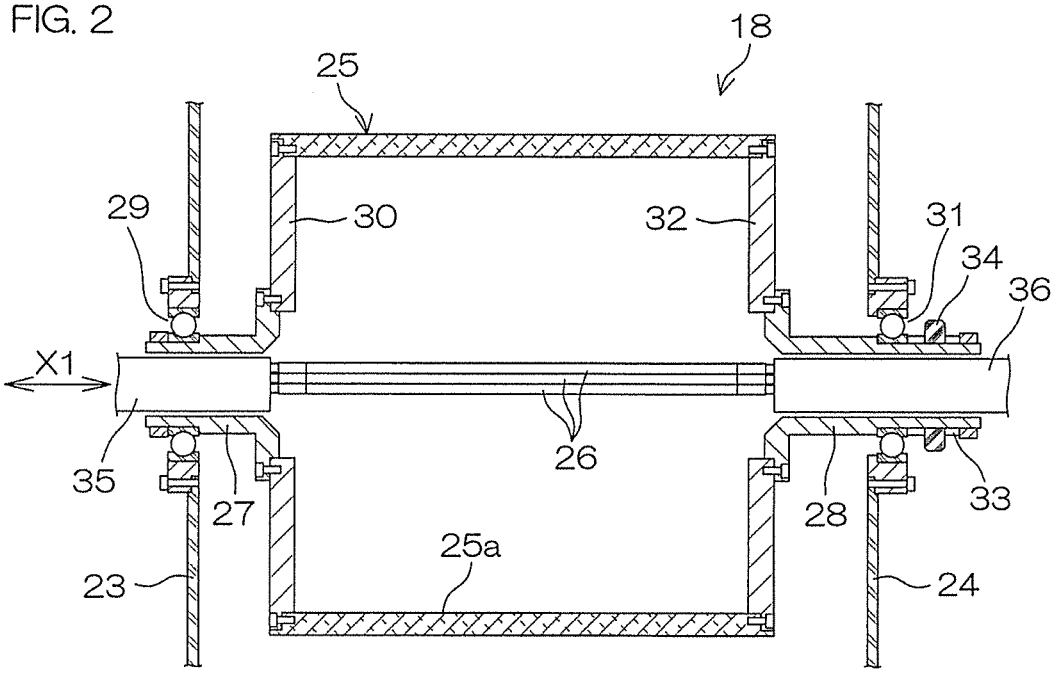
FIG. 2 is a sectional view of the general arrangement of a heat roller, according to a preferred embodiment of the present invention, that is incorporated in the inkjet printing apparatus of FIG. 1.

FIG. 2 is a sectional view of the general arrangement of the heat roller 18, according to a preferred embodiment of the present invention, that is incorporated in the inkjet printing apparatus 2 of FIG. 1.

The heat roller 18 is provided at a pair of conveyance side plates 23 and 24 in the exit unit 7. The conveyance side plates 23 and 24 constitute side surfaces of the conveyance path 8 for the printing medium P and are provided along the conveyance path 8.

The heat roller 18 includes a hollow cylindrical roller body 25 disposed between the pair of conveyance side plates 23 and 24, halogen lamps 26 disposed inside the roller body 25, and rotating shafts 27 and 28, making the roller body 25 rotate around a horizontal central axis X1.

The rotating shaft 27 extends in a horizontal direction along the central axis X1. The rotating shaft 27 penetrates through the conveyance side plate 23 and is rotatably held by the conveyance side plate 23 via a bearing 29. A disk-shaped flange 30 is coupled to one end of the rotating shaft 27 that penetrates through the conveyance side plate 23 and projects between the pair of conveyance side plates 23 and 24, and the flange 30 is fitted to an opening at one end of the roller body 25 at the conveyance side plate 23 side.

The rotating shaft 28 extends in the horizontal direction along the central axis X1. The rotating shaft 28 penetrates through the conveyance side plate 24 and is rotatably held by the conveyance side plate 24 via a bearing 31. A disk-shaped flange 32 is coupled to one end of the rotating shaft 28 that penetrates through the conveyance side plate 24 and projects between the pair of conveyance side plates 23 and 24, and the flange 32 is fitted to an opening at one end of the roller body 25 at the conveyance side plate 24 side. A pulley 33 is externally fitted to the other end of the rotating shaft 28 that projects to an outer side (right side in the figure) of the conveyance side plates 23 and 24. A timing belt 34 is wound between the pulley 33 and a pulley of an unillustrated electric motor.

The roller body 25, the rotating shafts 27 and 28, the flanges 30 and 32, and the pulley 33 are disposed concentrically with the central axis X1 as a center. When the electric motor is driven, its rotating force is transmitted via the timing belt 34 to the pulley 33 and therefrom to the rotating shaft 28 and the roller body 25, the rotating shafts 27 and 28, and the flanges 30 and 32 are rotated integrally around the central axis X1.

The rotating shafts 27 and 28 are both hollow shafts, and a pair of holders 35, 35, arranged to hold the halogen lamps 26 inside the roller body 25, are inserted into the rotating shafts 27 and 28, respectively. In the present preferred embodiment, each halogen lamp 26 has the form of a straight tube with terminals provided at both ends, and three halogen lamps 26 are held between the pair of holders 35, 35. At tips of the holders 35, 35 respectively facing an interior of the roller body 25 are provided unillustrated sockets that are connected to the terminals at both ends of the three halogen lamps 26, hold the halogen lamps 26 inside the roller body 25, and are arranged to feed electric power for lighting to the halogen lamps 26.

Although in the preferred embodiment, three halogen lamps 26 are held inside the roller body 25, there may be one or two or four or more halogen lamps 26.

In the present preferred embodiment, the roller body 25 is restricted to that with a thermal conversion efficiency of not less than 70%. As mentioned above, by selecting and using the roller body 25 with the thermal conversion efficiency of not less than 70%, light from the halogen lamps 26 can be absorbed as efficiently as possible by the roller body 25 to enable shortening of a heating rise time of the heat roller 18 and lowering of consumption power required for heating the heat roller 18 to a predetermined temperature. Also, temperature rise of air inside the roller body 25 can be suppressed to suppress damaging of the halogen lamps 26 and the roller body 25.

To make the thermal conversion efficiency of the roller body 25, constituted of aluminum or an aluminum alloy, not less than 70%, it is preferable to apply processing to an inner peripheral surface 25*a* of the roller body 25 that would absorb light at a higher efficiency than a black alumite film, etc. As such processing, for example, one type among the following may be cited:

(1) needle-like structures with an aspect ratio of not less than 2 and not more than 30, (2) an anodic oxide film with a thickness of not less than 30 μm and not more than 100 μm, or (3) a composite coating film of fluororesin and ceramic.

Figure 3:
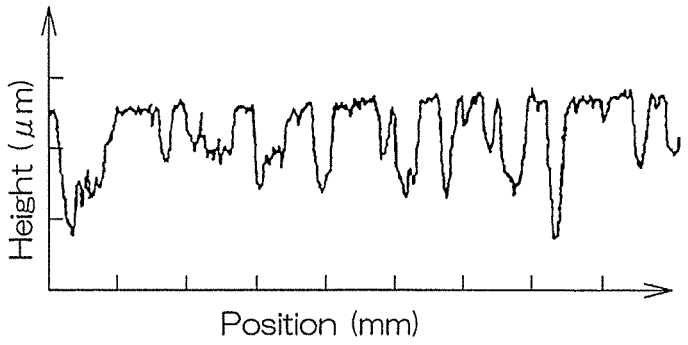
FIG. 3 is a graph of an example of a roughness curve of a surface of needle-like structures formed on an inner peripheral surface of a roller body of the heat roller.

FIG. 3 is a graph of an example of a roughness curve of a surface of the needle-like structures of (1) formed on the inner peripheral surface 25*a* of the roller body 25. In FIG. 3, the intervals of the divisions of the abscissa and the ordinate are 1 mm per division for the abscissa and 50 μm per division for the ordinate. The needle-like structures of (1) are constituted of numerous recesses and projections between the respective recesses that are formed on the inner peripheral surface 25*a* of the roller body 25. The needle-like structures of (1) are formed, for example, by preparing the inner peripheral surface 25*a* of the roller body 25, constituted of aluminum or an aluminum alloy, as necessary by performing corrugation, blasting, etc., and thereafter further performing chemical etching.

Preferably, hydrofluoric acid is used in the chemical etching. Hydrofluoric acid is high in anisotropy of etching rate with respect to a surface (the inner peripheral surface 25*a*) of aluminum or an aluminum alloy, is capable of etching such surfaces more greatly in a depth direction than a width direction, and is therefore suited for making the inner peripheral surface 25*a* of the roller body 25 have needle-like structures.

The aspect ratio, that is, the ratio, (depth)/(opening width) of depth and opening width of the recesses of the needle-like structures of (1) is set, as mentioned above, to be not less than 2 and not more than 30. If the aspect ratio is less than this range, the opening width of the recesses is large with respect to the depth and therefore a proportion at which the light from the halogen lamps 26 taken inside the recesses is radiated outside the recesses without being converted to heat would be large. There would thus be a possibility that the range of thermal conversion efficiency of not less than 70% would not be satisfied by the roller body 25 as a whole. On the other hand, needle-like structures of large aspect ratio such that the aspect ratio exceeds the abovementioned range cannot be formed practically. That is, with chemical etching, the recesses can be made deeper as etching time is made longer. However, tips of the projections are also etched at the same time and therefore even if the etching time is made long, it would be difficult to form needle-like structures of large aspect ratio such that the aspect ratio exceeds the abovementioned range.

The depth of the recesses of the needle-like structures of (1) is preferably not less than 5 μm and not more than 300 μm. If the depth of the recesses is less than the above range, the depth of the recesses is insufficient, and if the depth of the recesses exceeds the above range, the opening width is too large. Therefore, in either case, the proportion at which the light from the halogen lamps 26 taken inside the recesses is radiated outside the recesses without being converted to heat would be large and there is a possibility that the range of thermal conversion efficiency of not less than 70% would not be satisfied by the roller body 25 as a whole.

Figure 4:
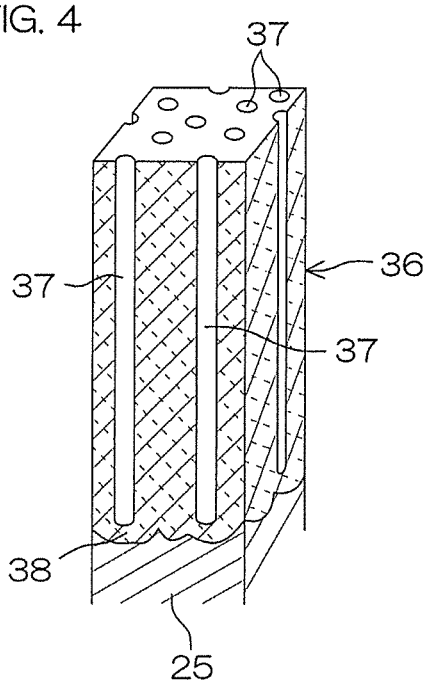
FIG. 4 is a sectional view of an example of the structure of an anodic oxide film formed on the inner peripheral surface of the roller body of the heat roller.

FIG. 4 is a sectional view of an example of the structure of an anodic oxide film 36 of (2) formed on the inner peripheral surface 25*a* of the roller body 25. The anodic oxide film 36 of (2) is formed, for example, by preparing the inner peripheral surface 25*a* of the roller body 25, constituted of aluminum or an aluminum alloy, as necessary by performing corrugation, blasting, etc., and thereafter performing anodization. In the forming process, a natural oxide film of approximately 20 Å thickness formed on the inner peripheral surface 25*a* in air is grown by the anodization to form a barrier coating film 38. When the barrier coating film 38 is then grown to a thickness of approximately 150 to 250 Å, numerous pores 37, having an opening diameter of approximately 100 Å, form in its surface. As the anodization is continued further, dissolution and formation of the film progress simultaneously at the pore 37 portions such that along with the growth of the film (anodic oxide film 36), the pores 37 become deeper in depth with the diameter of the pores 37 staying the same. Also, the film grows further into an interior of the roller body 25 than a reference surface of the inner peripheral surface 25*a*, and the anodic oxide film 36 shown in FIG. 4 is thereby formed.

As mentioned above, the thickness of the anodic oxide film 36 of (2) is set to not less than 30 lam and not more than 100 μm and thus thicker than that of an ordinary anodic oxide film. To form the anodic oxide film 36 (hard anodic oxide film) with a thickness within the above range, a current density may be made higher than ordinary to increase a film forming rate and a temperature of an electrolytic solution may be lowered to suppress the dissolution of the film at a low level.

The thickness of the anodic oxide film 36 is set within the above range for the following reason. That is, if the thickness is less than the above range, the depth of the pores 37 is insufficient. A proportion at which the light from the halogen lamps 26 taken inside the pores 37 is radiated outside the pores 37 without being converted to heat would then be large and there is a possibility that the range of thermal conversion efficiency of not less than 70% would not be satisfied by the roller body 25 as a whole.

On the other hand, although the anodic oxide film 36 is a nonconductor and therefore the processing voltage must be increased as the thickness of the anodic oxide film 36 increases, there is a tendency for the number of the pores 37 to lessen and the diameter of the pores 37 to increase with increasing voltage. When the thickness of the anodic oxide film 36 exceeds the above range, the number of pores 37 becomes too low. Therefore, it may not be possible for the pores 37 to take in the light from the halogen lamps 26 sufficiently or the diameter of the pores 37 may become too large such that the proportion at which the light from the halogen lamps 26 taken inside the pores 37 is radiated outside the pores 37 without being converted to heat would increase. Therefore, in either case, there is a possibility that the range of thermal conversion efficiency of not less than 70% would not be satisfied by the roller body 25 as a whole.

The composite coating film of fluororesin and ceramic of (3) is formed, for example, by coating a coating agent on the inner peripheral surface 25*a* of the roller body 25 that has been prepared as necessary by performing corrugation, blasting, etc., and thereafter baking. The coating agent may, for example, be a coating agent, with which fine particles of the ceramic are combined with a dispersion for fluorine coating film formation that contains fine particles of the fluororesin. Also, the coating agent may be a coating agent combining a ceramic precursor, capable of forming a ceramic coating film by a sol-gel method, and fine particles of the fluororesin, such as PTFE, etc.

Also, the composite coating film of (3) may have a multilayer structure with two or more layers. Specifically, the film may have a two-layer structure that includes a primer layer and a topcoat layer. The primer layer is a layer with which adhesion with respect to the inner peripheral surface 25*a* of the roller body 25 constituted of aluminum or an aluminum alloy, is made high by adjusting a ratio of the fluororesin and the ceramic. The topcoat layer is a layer that is formed on the primer layer and is imparted with hardness, non-adhesive property, etc., by adjusting the ratio of the fluororesin and the ceramic.

As mentioned above, the composite coating film of (3) has a porous structure, constituted of fine particles of the ceramic, in its interior and a proportion at which the light from the halogen lamps 26 taken inside the porous structure is radiated outside the film without being converted to heat can be made low. Thus, the ratio of the ceramic or its precursor and the fluororesin in the coating agent and the thickness of the composite coating film may be adjusted to make the thermal conversion efficiency of the roller body 25 as a whole not less than 70%.

With the present invention, the thermal conversion efficiency of the roller body 25 as a whole shall be expressed by a value determined by the method described below.

That is, the halogen lamps 26 are disposed inside the roller body 25, for which the thermal conversion efficiency is to be determined. Then, while measuring a temperature of an outer peripheral surface of the roller body 25, power is supplied to light the halogen lamps 26 and a relationship, shown in FIG. 5, of elapsed time (minutes) from start of lighting of the halogen lamps 26 and the temperature Thr (° C.) of the outer peripheral surface of the roller body 25 is determined.

Here, if an ambient temperature during measurement is T0 (° C.), a light absorption rate of the roller body 25 is Q (%), and a heat radiation rate from the outer peripheral surface of the roller body 25 is H (%), a thermal equilibrium equation of formula (i) is derived between the temperature Thr (° C.) and time t (minutes) from thermal balance:

$$(dThr/dt)=Q-Hx(Thr-T0) \quad \text{(i)}$$

Figure 5:
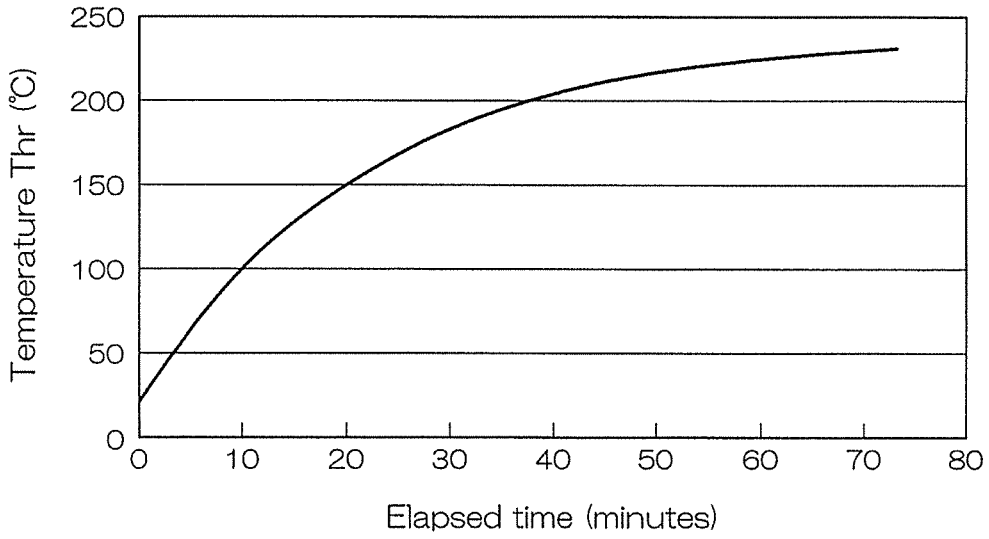
FIG. 5 is a graph of an example of relationship of elapsed time from start of lighting of halogen lamps and a temperature of an outer peripheral surface of the roller body.

Also, when thermal equilibrium, that is, (dThr/dt)=0 is achieved, a convergence temperature Thr=$T^{\infty}$ at the thermal equilibrium is given by formula (ii):

$$T^{\infty}=T0+(Q/H) \quad \text{(ii)}$$

and values of the light absorption rate Q and the heat radiation rate H are determined by performing convergent calculation of Q/H with the measurement results of FIG. 5. Also, the convergence temperature $T^{\infty}$ at thermal equilibrium is determined from the formula (ii).

Next, the same measurements and calculations are performed on a roller body 25 of known thermal conversion efficiency, which is constituted of an extruded material of aluminum and with which the inner peripheral surface 25*a* is left as it is in a non-processed, bare state. Let the light absorption rate determined thereby be Q0. Using this, the light absorption ratio Q/Q0 is determined and based on the ratio Q/Q0, the thermal conversion efficiency of the roller body 25 as the measured object is calculated.

Results of determining the thermal conversion efficiency by the above-described method for samples of the roller body 25, on which various types of processing has been applied to the inner peripheral surface 25*a*, are described below.

(Sample 1)

The roller body 25, constituted of the extruded material of aluminum and with which the inner peripheral surface 25*a* is left as it is in the non-processed, bare state, was deemed as Sample 1. The thermal conversion efficiency was 57.1%.

(Sample 2)

The inner peripheral surface 25*a* of the roller body 25 of Sample 1 was prepared by corrugating and then blasting and thereafter anodized to form an anodic oxide film of 16 μm thickness, which was further colored black by nickel plating and thereby made into a black alumite film.

(Sample 3)

The inner peripheral surface 25*a* of the roller body 25 of Sample 1 was prepared by corrugating and then blasting and thereafter anodized to form an anodic oxide film 36 of (2) of 60 μm thickness.

(Sample 4)

The inner peripheral surface 25*a* of the roller body 25 of Sample 1 was prepared by corrugating and then blasting. The composite coating film of (3), having a two-layer structure with a black primer layer, constituted of fluororesin and ceramic and having a thickness of approximately 16 μm, and a transparent topcoat layer, constituted of fluororesin and ceramic and having a thickness of approximately 8 μm, was then formed.

(Sample 5)

The inner peripheral surface 25*a* of the roller body 25 of Sample 1 was prepared by corrugating and then blasting and thereafter chemically etched with hydrofluoric acid to form the needle-like structures of (1) with the aspect ratio being in the range of 5 to 10.

For each of the Samples 1 to 5, the graph shown in FIG. 5 was prepared by the method described above and the light absorption rate Q, the heat radiation rate H, and the convergence temperature $T^{\infty}$ at thermal equilibrium were determined. Then, using the light absorption rate of Sample 1 as Q0, the absorption rate ratios Q/Q0 were determined and the thermal conversion efficiencies of Samples 2 to 5 were determined from the thermal conversion efficiency (57.1%) of Sample 1. The results are shown in Table 1.

TABLE 1

| | Type of processing | Light absorption rate Q (%) | Heat radiation rate H (%) | Convergence temperature T∞ (° C.) | Thermal conversion efficiency (%) |
|---|---|---|---|---|---|
| Sample 1 | Bare | 9.78 (Q0) | 0.0442 | 241 | 57.1 |
| Sample 2 | Black alumite film | 11.32 | 0.0660 | 192 | 66.0 |
| Sample 3 | Anodic oxide film of (2) | 13.34 | 0.0732 | 202 | 77.8 |
| Sample 4 | Composite coating film of (3) | 15.03 | 0.0758 | 218 | 87.7 |
| Sample 5 | Needle-like structures of (1) | 15.33 | 0.0783 | 216 | 89.5 |

From Table 1, it was confirmed that, by applying any processing among (1) to (3) to the inner peripheral surface 25*a* of the roller body 25, constituted of aluminum, the thermal conversion efficiency of the roller body 25 can be improved to not less than 70% while maintaining the convergence temperature $T^{\infty}$ approximately equal to that of Sample 2, with which a black alumite film was formed.

Although preferred embodiments of the present invention were described above, the present invention may be implemented in other modes.

For example, although a case of using the heat roller 18 for drying the ink printed on the printing medium P in the inkjet printing apparatus 2 was described as an example, the present invention may be applied to types of printing apparatus besides the above. For example, the heat roller 18 may also be used to fix a toner image printed on a printing medium in an electrographic printing apparatus. Also, although a long size web was described as an example of the printing medium, the printing medium may be paper sheets, etc. Also, although with the preferred embodiment described above, any one structure among (1) to (3) described above is implemented in a form of being formed on the inner peripheral surface 25*a* of the roller body 25, two or more of the structures among (1) to (3) may also be implemented in combination. Also, any one structure among (1) to (3) and another structure may be combined in a slightly modified form. For example, if the needle-like structures of Sample 5 are to be blackened further, anodization may be applied to the needle-like structures of Sample 5 to form a black alumite film with a thickness of approximately not less than 13 μm and not more than 16 μm.

Besides the above, various design modifications may be made within the scope of the matters described in the claims.

The present application corresponds to Japanese Patent Application No. 2017-065203 filed in the Japan Patent Office on Mar. 29, 2017, and the entire disclosure of this application is incorporated herein by reference.

While preferred embodiments of the present invention have been described in detail above, these are merely specific examples used to clarify the technical content of the present invention, and the present invention should not be interpreted as being limited only to these specific examples, and the scope of the present invention shall be limited only by the appended claims.

What is claimed is:

1. A heat roller comprising;

a hollow cylindrical roller body; and a halogen lamp disposed inside the roller body, wherein the roller body is constituted of aluminum or an aluminum alloy, and has at least one structure selected from a group consisting of:

(1) needle-like structures with an aspect ratio of not less than 2 and not more than 30;

(2) an anodic oxide film with a thickness of not less than 30 μm and not more than 100 μm; and (3) a composite coating film of fluororesin and ceramic, and wherein the at least one structure is formed on an inner peripheral surface to make a thermal conversion efficiency of light from the halogen lamp is not less than 70%.

2. A printing apparatus comprising:

a conveyance path for a printing medium;

a printing unit performing printing by an inkjet printing method on the printing medium conveyed along the conveyance path; and a heat roller according to claim 1, disposed at a downstream side in a printing medium conveyance direction of the conveyance path than the printing unit.

* * * * *